US007472450B2

(12) United States Patent
Silva

(10) Patent No.: US 7,472,450 B2
(45) Date of Patent: Jan. 6, 2009

(54) MULTI-COLOR FAUX ART PALETTE SYSTEM

(76) Inventor: Sandra S. Silva, 5451 NW. 180 Ter., Opalocka, FL (US) 33055

( * ) Notice: Subject to any disclaimer, the term of this patent is extended or adjusted under 35 U.S.C. 154(b) by 0 days.

(21) Appl. No.: 11/497,728

(22) Filed: Aug. 2, 2006

(65) Prior Publication Data

US 2007/0006416 A1 Jan. 11, 2007

Related U.S. Application Data

(63) Continuation-in-part of application No. 10/439,300, filed on May 16, 2003, now abandoned.

(51) Int. Cl.
*B05C 17/00* (2006.01)

(52) U.S. Cl. ..... 15/244.1; 118/264

(58) Field of Classification Search ..... 15/244.1, 15/244.2, 244.3, 244.4; D32/40, 42; 118/264
See application file for complete search history.

(56) References Cited

U.S. PATENT DOCUMENTS

| | | | | | |
|---|---|---|---|---|---|
| 972,359 | A | * | 10/1910 | Gibson | 101/379 |
| 2,518,765 | A | * | 8/1950 | Ecker | 15/115 |
| 2,684,012 | A | * | 7/1954 | Hebert | 352/50 |
| 3,002,213 | A | * | 10/1961 | Lindstrom | 15/244.1 |
| 3,180,260 | A | * | 4/1965 | Joseph | 101/401.1 |
| 3,317,944 | A | * | 5/1967 | Napier et al. | 15/244.1 |
| 3,465,377 | A | * | 9/1969 | Thomas | 15/147.1 |
| 3,669,069 | A | * | 6/1972 | Bourboulis | 118/102 |
| 3,817,178 | A | * | 6/1974 | Hagen | 101/379 |
| 4,030,414 | A | * | 6/1977 | McGuire | 101/379 |
| 4,111,666 | A | * | 9/1978 | Kalbow | 51/295 |
| 4,864,677 | A | * | 9/1989 | Levy | 15/210.1 |
| 4,982,472 | A | * | 1/1991 | Lustofin | 15/244.1 |
| 5,655,451 | A | | 8/1997 | Wasylczuk et al. | |
| D403,813 | S | * | 1/1999 | Channer | D32/40 |
| 5,966,772 | A | | 10/1999 | Woodnorth et al. | |
| D429,861 | S | * | 8/2000 | Denney | D32/40 |
| D446,895 | S | * | 8/2001 | Denney | D32/40 |
| D447,299 | S | * | 8/2001 | Denney | D32/40 |
| D447,300 | S | * | 8/2001 | Denney | D32/40 |
| 6,289,548 | B2 | | 9/2001 | Capoccia | |
| 6,330,731 | B1 | | 12/2001 | Jackson et al. | |
| 6,331,327 | B1 | | 12/2001 | Jackson et al. | |
| 6,641,664 | B1 | * | 11/2003 | Giallourakis | 118/264 |

* cited by examiner

*Primary Examiner*—Randall Chin
(74) *Attorney, Agent, or Firm*—Melvin K. Silverman; Yi Li

(57) ABSTRACT

A multi-color faux art palette system includes a number of liquid pigments of different colors and a palette having a resilient substrate having an upper and a bottom surface. The bottom surface includes a handle integrally dependent from the bottom surface of the substrate. Upon the top surface are secured discrete substantially planar color-absorbent sponges, arranged in a pattern to define a faux-art pattern of interest, each sponge having a bottom surface integrally dependent from the upper surface of the resilient substrate. Opposing edges of the planar sponges are separated from each other by a distance sufficient to preclude contact between them when the sponges are compressed against a planar surface.

6 Claims, 11 Drawing Sheets

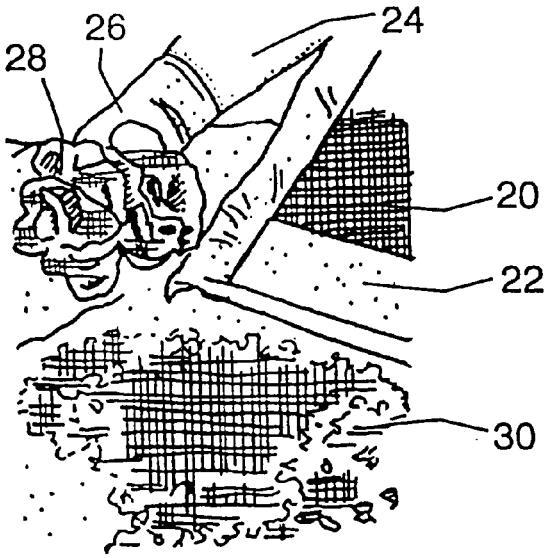
Fig.1
Prior Art
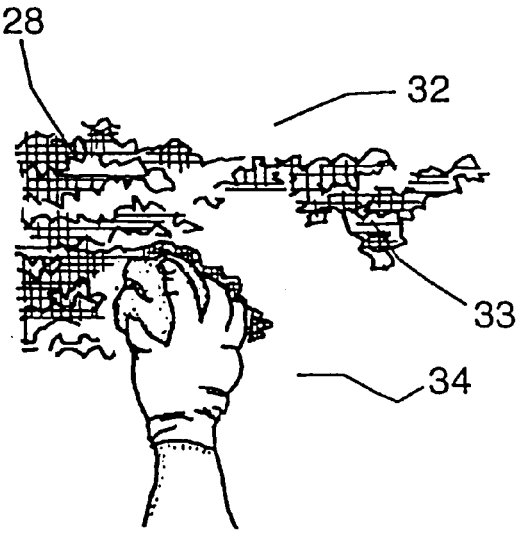
Fig.2
Prior Art
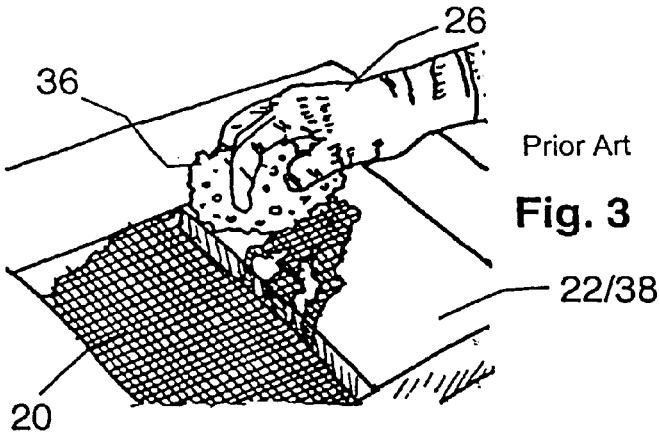
Prior Art
Fig. 3
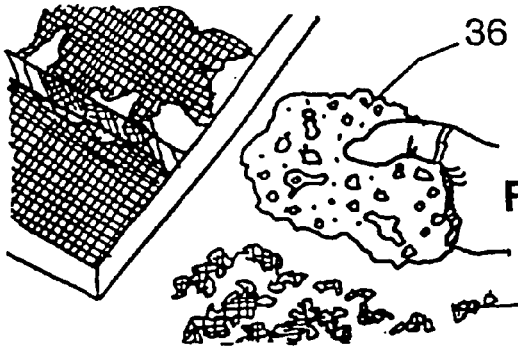
Prior Art
Fig. 3A
Prior Art
Fig. 4
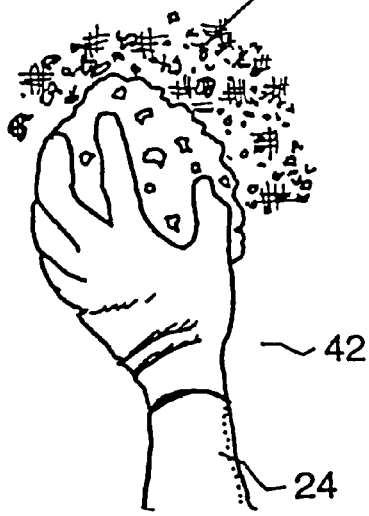

MULTI-COLOR FAUX ART PALETTE SYSTEM

REFERENCE TO RELATED APPLICATION

This application is a continuation-in-part of, and claims the benefit of, application Ser. No. 10/439,300, filed May 16, 2003, entitled Multi-Color Faux Art Palette System, the entire content of which is expressly incorporated herein by reference.

BACKGROUND OF THE INVENTION (A) Area of Invention

The invention relates to palettes and tools of application used by artists and, more particularly, to a multi-color palette system having particular application in the area of faux art.

(B) Prior Art

Faux art is a very exacting and labor intensive art form. Therein, the artist must often operate at considerable heights and at distances from the source of the various types and sources of pigment, i.e., liquid and viscous color which one must use. However, because of the weight and quantity of color used in faux art, a conventional artist's palette containing small dabs of paste-like oil paint, has never offered a practical solution.

Some parties, in an effort to address this problem, have suggested the use of a multi-color paint roller for purposes of faux finish application. as is reflected in U.S. Pat. No. 6,330,731 (2001) to Jackson, et al entitled Faux Finish Applicator and U.S. Pat. No. 6,331,327 (2001) also to Jackson, et al, entitled Faux Finish Method. However, such solutions to application and color in faux finishing are limited to the two different colors and a specific pattern that a roller of the type of Jackson can accommodate. Other efforts to address the above difficulties in faux art supply and finishing that involve the use of an improved roller and paint supply are reflected U.S. Pat. No. 5,966,772 (1999) to Woodnorth, et al, entitled Paint Supply and Finishing System; and U.S. Pat. No. 6,289,548 (2001) to Capoccia, entitled Synthetic Torn Patterned Roller And Its Method Of Production. Solutions of this type, while providing for special faux art effects, do not help the faux artist in the many labor and time intensive aspects of various forms of faux finishing.

The prior art of faux finish applicators also includes the utilization of selectably different interlocking stamp sets, each of which may be provided with a different color, pattern, or design such that, after such a system is assembled and loaded with color, the artist may take such a stamp set onto a ladder, or to a location remote from the color source, to more easily provide the colors and patterns of the elements of the stamp set at such a location. A stamp set of this type is taught in U.S. Pat. No. 5,655,451 (1997) to Wasylczuk, et al, entitled Interfitting Stamp Set For Faux Finishing. The within invention however employs substrate that requires pre-selection of color or pigment, but not assembly of units thereof.

As may be noted from the above, the prior art does not teach or suggest an analog of the classical artist palette that would be practical for use in the area of faux art.

The term color, as used herein, and throughout this application, is defined to include the term pigment, whether in liquid or paste form.

Further, for purposes of clarity, the term "faux art" as used herein and throughout the application, is used to mean that one is not looking at a genuine article, but rather a man-made material created to simulate something organic or naturally-occurring. The Merriam-Webster Dictionary gives the example of faux marble, which is a finished that is painted to closely resemble real marble.

It is accordingly toward this end that the present invention is directed.

SUMMARY OF THE INVENTION

The instant invention pertains to a multi-color faux art palette system comprising a plurality of liquid pigments of different colors and a resilient substrate having an upper and a bottom surface. Said bottom surface includes handle means integrally dependent from said bottom surface of said substrate. Upon said top surface are secured a plurality of discrete substantially planar color-absorbent sponges, arranged in a pattern to define a faux-art pattern of interest, each sponge thereof having a bottom surface integrally dependent from said upper surface of said resilient substrate. Therein, opposing edges of said sponges are separated from each other by a distant sufficient to preclude contact therebetween when said sponges are compressed against a planar surface.

It is accordingly an object of the present invention to provide a palette system particularly adapted for use in faux art.

It is another object to provide a palette of the above type to reduce the time and labor associated with the application of faux art finishes to surfaces.

It is a further object to provide a multi-color faux art palette system to enhance the ease and convenience of the application of sponge, rag and other faux art tools to surfaces to which a faux finish is to be applied.

It is a still further object to provide a multi-color faux art finishing system adaptable for use in achieving various faux art effects.

It is a yet further object to provide a more efficient means for the supply of faux paint colors during faux finish applications.

The above and yet other objects and advantages of the present invention will become apparent from the hereinafter set forth Brief Description of the Drawings, Detailed Description of the Invention and Claims appended herewith.

BRIEF DESCRIPTION OF THE DRAWINGS

FIGS. 1 and 2 are sequential views showing the prior art method of faux finishing known as ragging.

FIGS. 3, 3A, and 4 are sequential views showing the prior art method of faux finishing known as sponging.

DETAILED DESCRIPTION OF THE INVENTION

Figure 5:
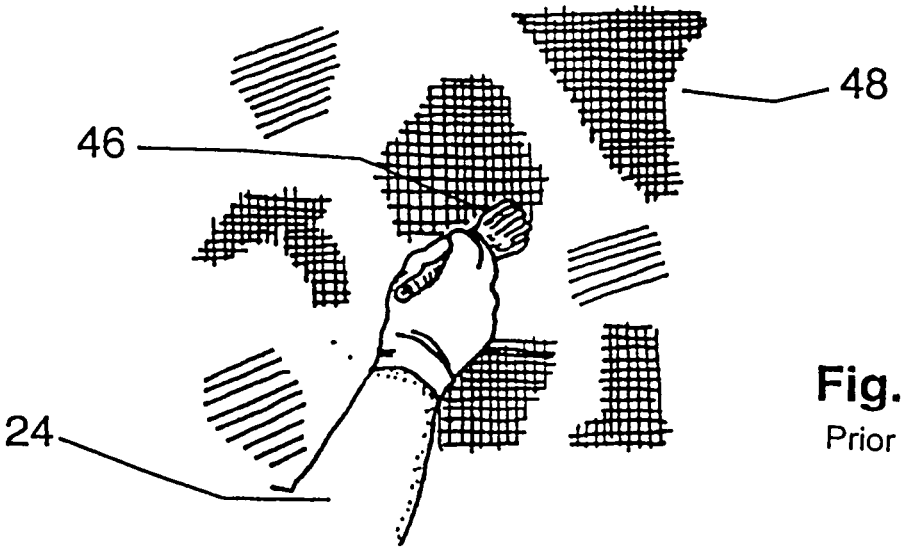
Fig. 5 Prior Art
FIGS. 5, 6 and 7 illustrate prior art methods of color washing and rubbing.

With reference to FIGS. 1 and 2, the prior art of faux finishing as it relates to the so-called ragging process associated therewith is shown. More particularly, in FIG. 1 is shown a liquid mixture 20 typically consisting of equal parts of paint, water and acrylic scumble glaze to thus achieve a consistency resembling that of a thin cream. The resulting mixture is held within a paint tray 22. After the faux artist 24 had donned latex gloves 26, a rag 28 is soaked in water (not shown) and then wrung out. The dampened rag 28 is then dipped into paint mixture 20 and any excess paint is wrung out to minimize potential dripping. Thereafter, the edges of rag 28 are bunched into a rose-like configuration with the indentations thereof pushed into the cloth with one's fingers to thereby provide it with a crushed appearance. The resulting pattern, and the desirability thereof to the artist, is tested by "pouncing" it on a piece of brown paper 30.

Ragging at a top area 32 of a wall 34 is shown in FIG. 2. The paint mixture 20 is applied with a light, "pouncing," random movement as the rag itself will produce distinctive faux patterns. It is also helpful to move one's entire arm, as opposed to a wrist only, to thereby cover a wider area of the wall 34. One must also constantly check the cloth to be sure that it retains its indentations to thus retain the desired pattern and, thereby, avoid flattening of the rag. It is also important not to twist the cloth on the wall in that this may cause smudging of the pattern. A typical work area for the ragging process shown in FIG. 2 is about 2 feet or 60 square centimeters.

In FIGS. 3, 3A and 4 is shown the prior art faux process known as sponging. As in the case of ragging, described above, substantially equal quantities of paint and solvent are mixed to form paint mixture 20. As above described with respect to the ragging step in FIG. 1, latex gloves 26 are used. A large sponge 36 is soaked in a bucket of solvent (not shown). The solvent is then squeezed out of sponge 36 such that it is left damp, not wet. Thereafter, sponge 36 is dipped into paint mixture 20 with the excess thereof squeezed out onto a flat portion 38 of tray 22. See FIG. 3. In FIG. 3A is shown the sponging step of using sponge 36 to test the sponge pattern and the amount of paint mixture by pouncing it onto a piece of brown paper 40. Said pattern will then appear either as a fine stippled effect or, by using the opposite so-called "brain" side, as a distinctive course or open pattern. In applying the sponge to wall 42 (see FIG. 4), one always holds the sponge in the same position to achieve a pattern 44 throughout the sponging process.

Figure 6:
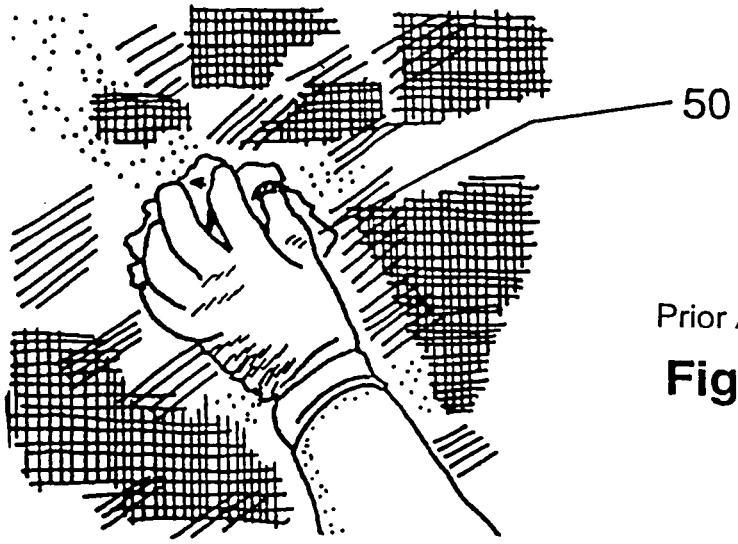
Prior Art Fig.6
Figure 7:
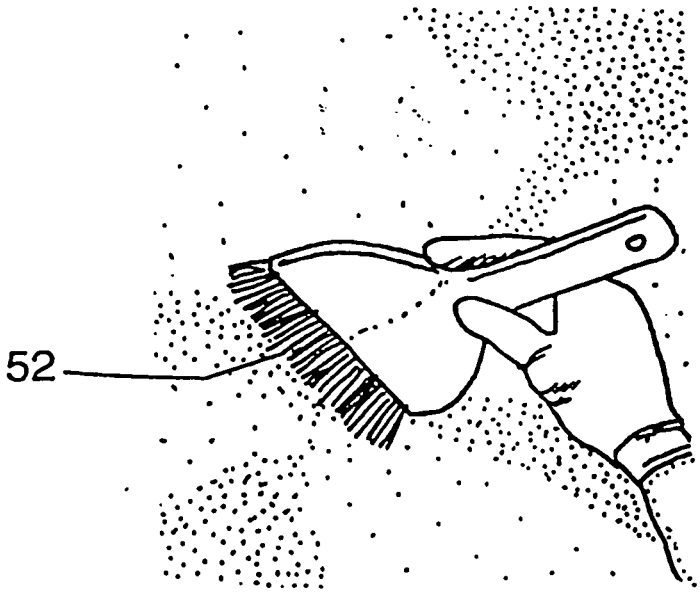
Fig.7 Prior Art

In FIGS. 5-7 are shown the prior methods of color washing and rubbing. That is, in FIG. 5 is shown the step of dabbing patches 46 of color upon a wet wall 48 while leaving a wet border around each section to enhance ease of blending with the adjoining area. In this process, the darkest color is applied in a honeycomb pattern. Thereafter, gaps therebetween are filled in with two lighter colors.

In FIG. 6 is shown the use of a damped cloth 50 in a twisting motion, starting with the palest color and then progressing to darker colors until they are fully blended. Rubbing with cloth 50 produces in a softer effect. A yet softer effect may be obtained with the use of a hake brush 52 (see FIG. 7). After allowing 24 hours for drying, a second or third rubbing may be employed.

In all of the above wall contact steps described with regard to FIGS. 2, 4, 5 and 7 above, it is necessary for the faux artist to constantly leave a ladder, scaffold, or other location remote from the source of one or more paint mixtures or colors with which one may be working. The use of multi-color in faux art is common and, as such, one of the more difficult and time consuming aspects of this art form is the need to repeatedly access one's source of color whenever one wishes to employ an additional color in the accomplishment of a given faux effect, an event which is frequent in most faux treatments.

The present invention addresses this problem through a multi-color palette 54 (see FIG. 8) which consists of a hard rubber substrate 56, a plurality of planar foam-like sponges 58, or a material having comparable properties as is the case with certain plastics. Sponges 58 are highly absorbent and retain a substantial volume of the color to be applied through one or more of the means described in FIGS. 2, 4 and 5 above.

Beneath substrate 56 which, typically, comprises a hard, but flexible, rubber, is a handle 60 which is permanently secured to substrate 56. The above elements are shown in front plan view in FIG. 9. It is to be appreciated that handle 60 may take a variety of forms including, for example, rungs or straps, while sponges 58 may assume essentially any conceivable planar geometry, as long as there are provided color dams 62 which afford sufficient separation between sponges 58 to thus preclude undesirable mixing of discrete colors which have been provided thereto when palette 54 is pushed or pounced against a surface as a step in the faux process.

Figure 8:
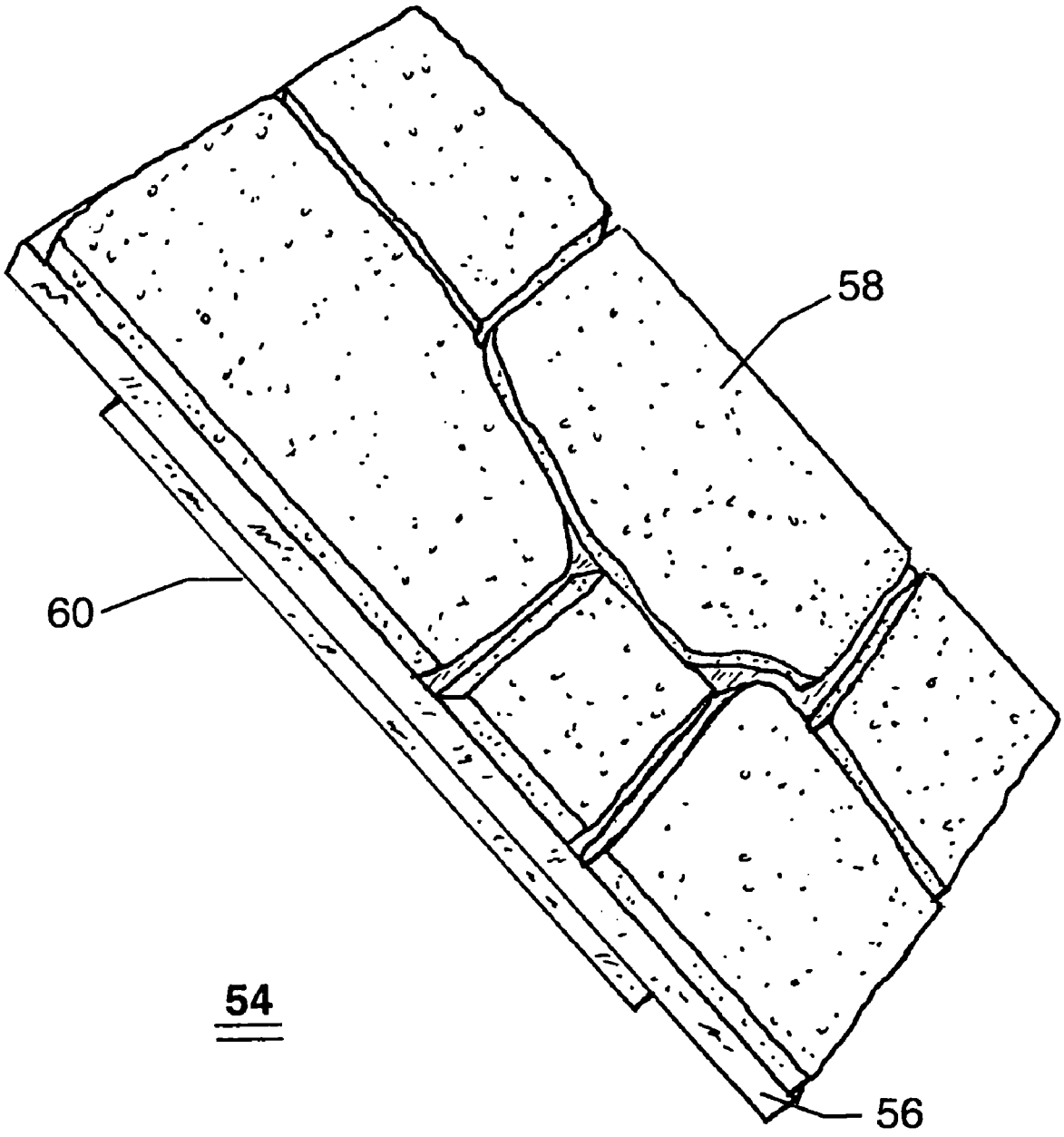
FIG. 8 is a perspective view of the inventive multi-color faux art palette.
Figure 9:
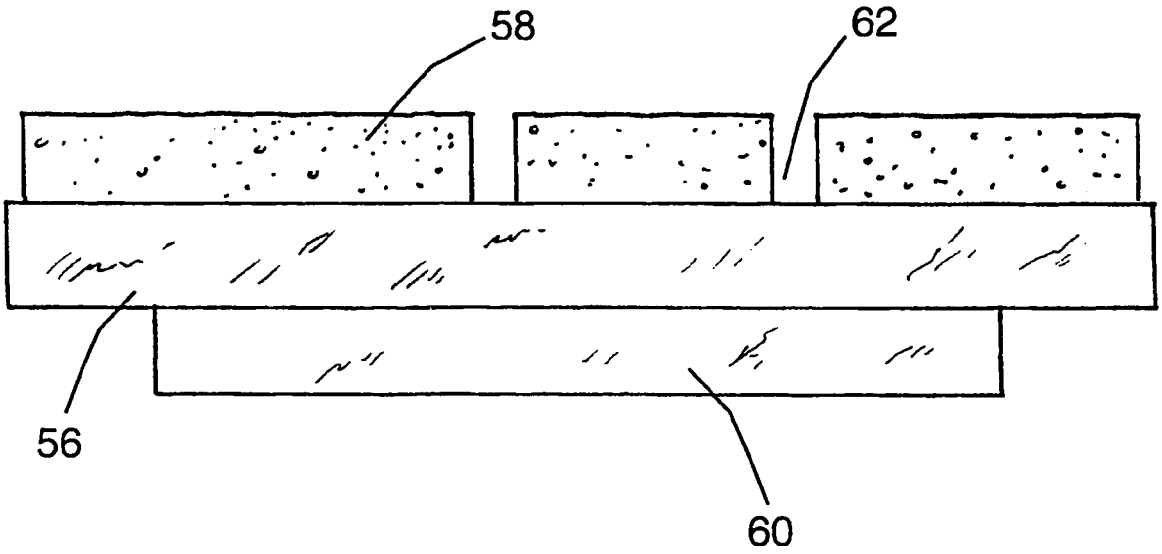
FIG. 9 is a side elevational view of the multi-color faux art palette shown in FIG. 8.
Figure 10:
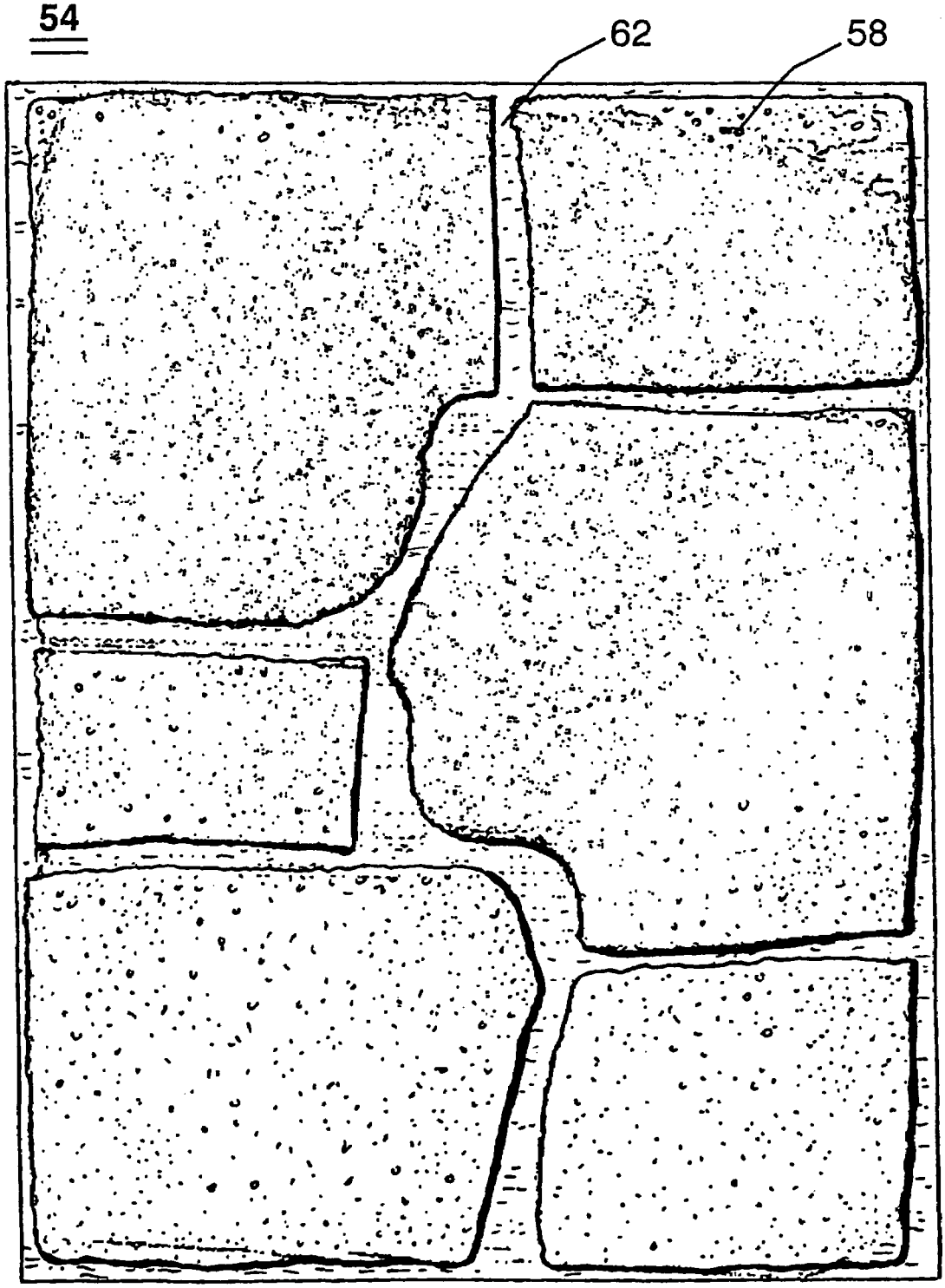
FIG. 10 is a top plan view of the multi-color faux art palette shown in FIG. 8.

FIG. 10 is a top view of the multi-color palette of FIGS. 8 and 9.

Figure 11:
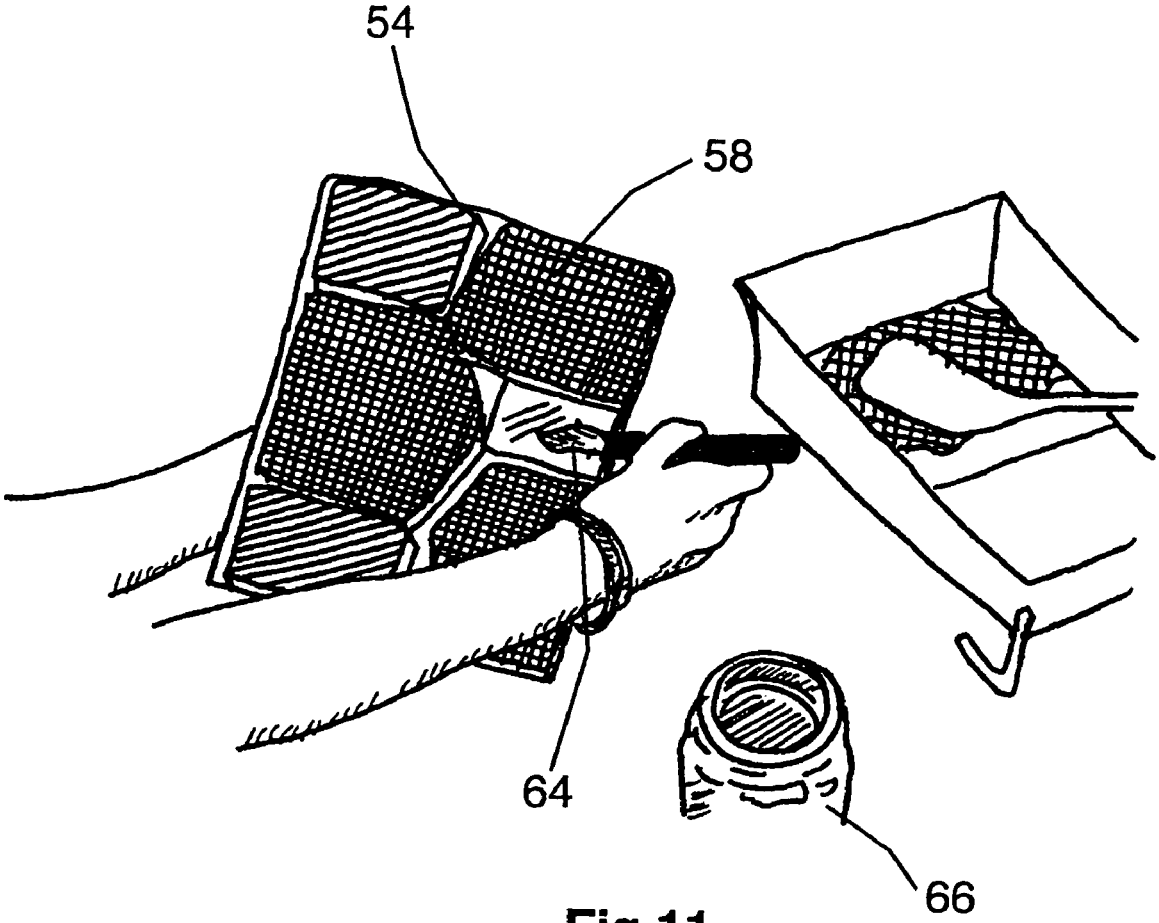
FIG. 11 shows a first step in the use of the inventive palette loading various colors in all faux applications.
Figure 12:
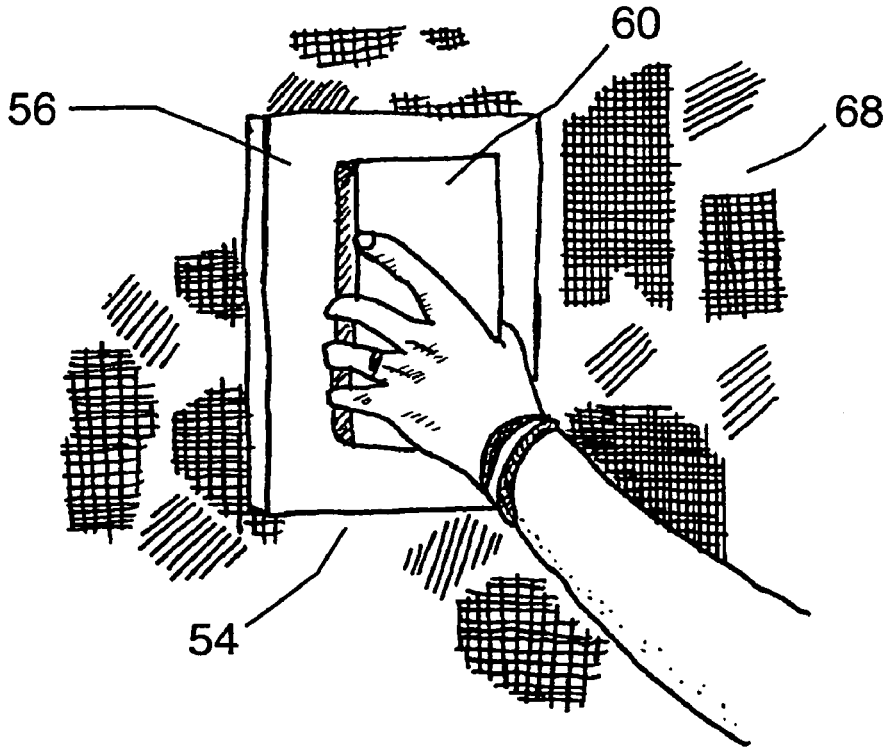
FIG. 12 illustrates the use of the palette applying colors directly to a wall to be finished.
Figure 13:
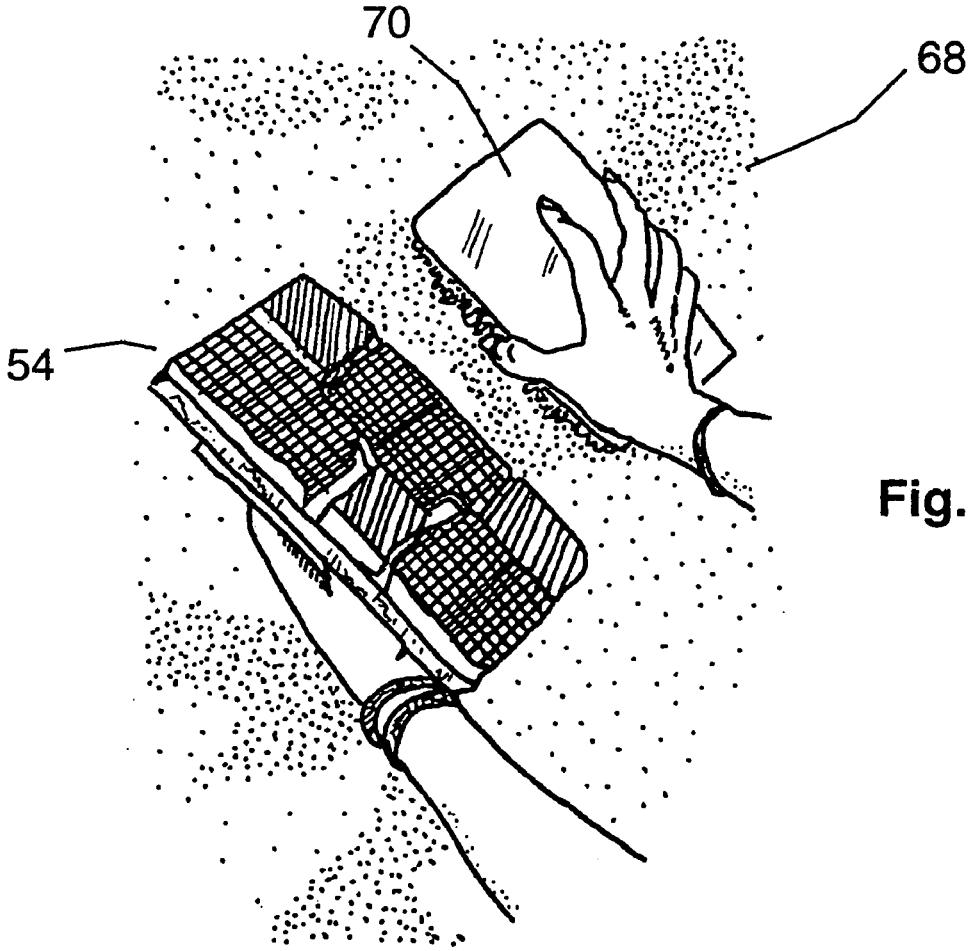
FIG. 13 shows the use of a faux tool in one hand of the artist to blend colors while the inventive palette is held in the other hand.

In FIGS. 11-17 is shown the utility of the inventive multi-color faux palette. More particularly, in FIG. 11 is shown the step of saturation and spreading of desired colors upon the respective sponges 58 of the palette using a brush 64, spoon, or any other tool. Also, because of the large capacity of a sponge to retain liquid, color may be poured directly from a jar 66 onto sponges 58.

Thereafter (See FIG. 12), the mixed color, often termed a glaze, is applied to a wall 68 in random positions pushing three or four times depending upon the working (curing) time of the glaze or wall finish. It has been found that the inventive multi-color palette 54 may be pressed against wall 68 up to ten times before it is necessary to re-load the color (as above described with respect to FIG. 11). Thereafter (see FIG. 13) various colors which have been applied to wall 68 from the multi-color palette 54 are blended using any desirable faux tool 70 inclusive of a cloth, woolie, plastic material, or sponge. After softening the blended colors, they are permitted to dry and, thereafter, any desired color may be added to obtain darker patterns within random areas upon the wall 68.

Figure 14:
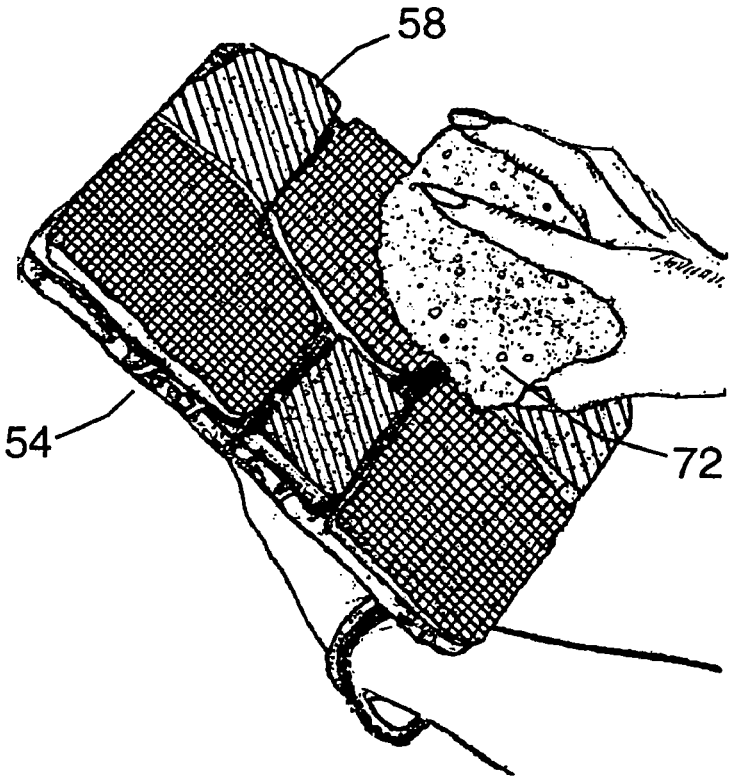
FIG. 14 shows the use of a sponge to obtain color from the planer sponges of faux palette.
Figure 15:
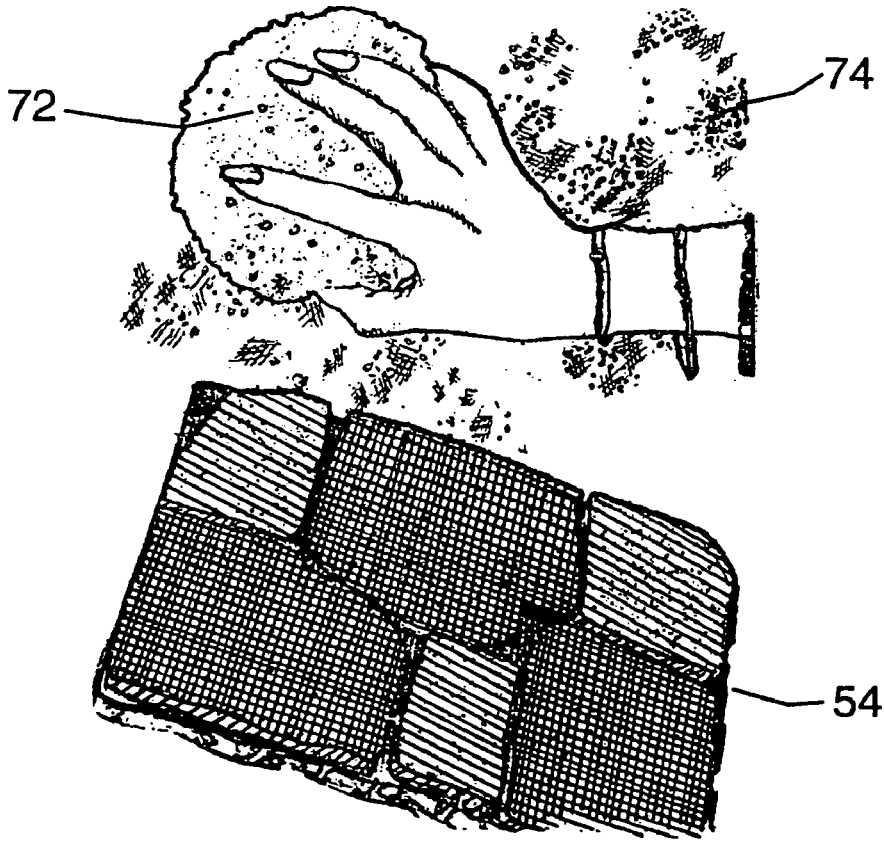
FIG. 15 shows the step sequential to that of FIG. 14 in which a sponge is used to apply color to a surface to be finished with the sponge.

The use of the present invention in a faux sponging step is shown in FIGS. 14-15. More particularly, therein is shown use of a sponge 72 to selectably access sponge portions 58 of the palette 54. Thereby the faux sponging step is made far easier with less messiness and greater control of the coloration process, as sponge 72 is pressed onto the palette thereby providing only as much color or glaze as is needed. Thusly, through the use the inventive tool, multi-colors within either the same or multiple faux sponges can be employed without necessity for the artist to change location to access the color source, thereby saving precious time and energy particularly when working upon high walls. Therein, due to the large color capacity of the sponges 58 of the palette 54, considerable areas can be fauxed before having to return to the source of color to re-load the palette with more color or glaze. The sponging process using the inventive palette is generally shown in FIG. 15.

Figure 16:
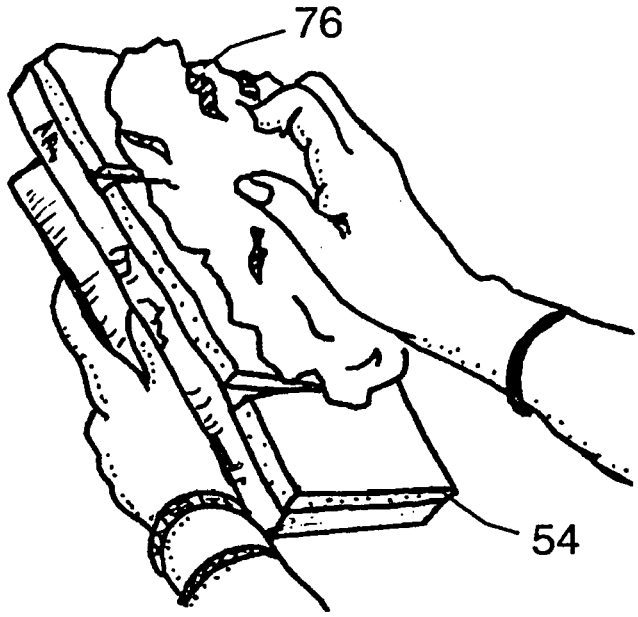
FIG. 16 shows the application of a faux rag to a planar sponge of the inventive palette.

In FIG. 16 is shown the use palette 54 with a rag 76. Thereby faux ragging is also made easier and accomplished with greater speed for the reasons set forth above with respect to faux sponging.

Figure 17:
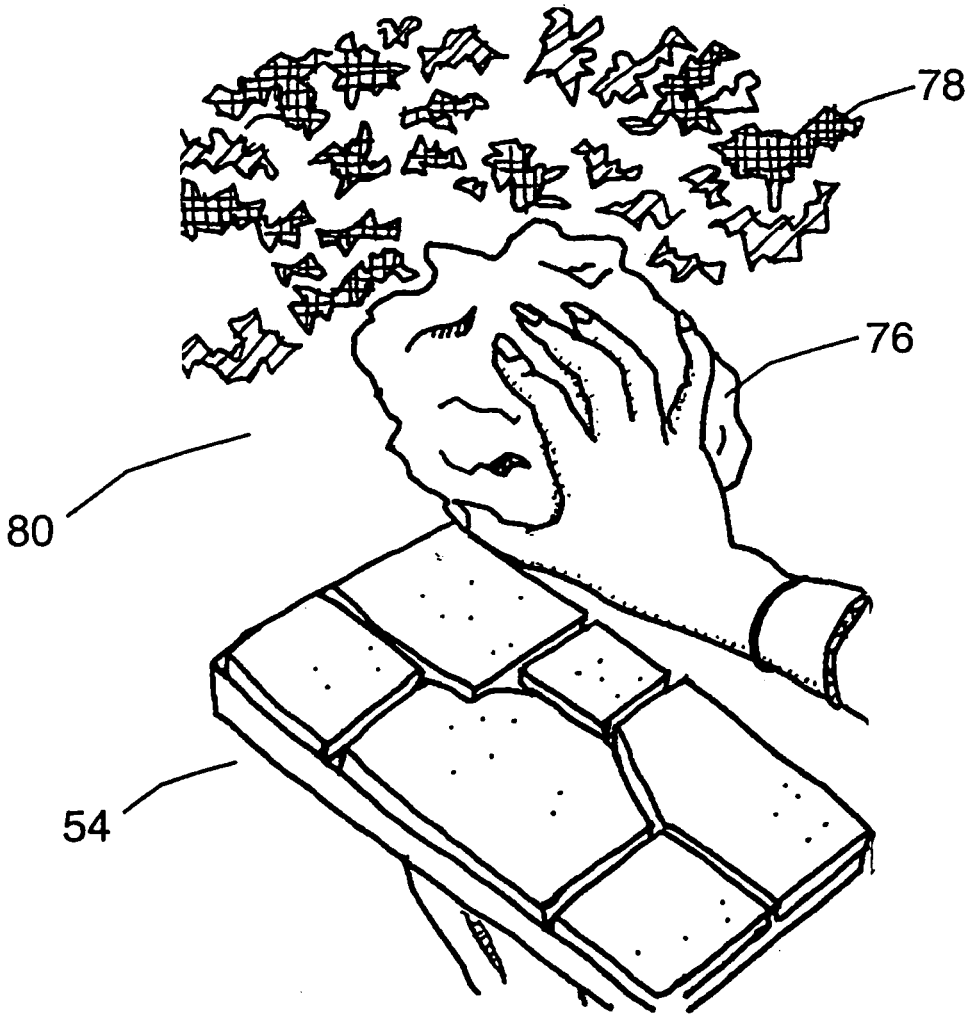
FIG. 17 shows the application of the rag of FIG. 16 to a surface to be faux finished.

In FIG. 17 is shown patterns 78 on wall 80 and its comparability to that of prior art ragging patterns 33 upon wall 34 (see FIG. 2) which is achieved only with much greater effort.

It is also noted that texturing, typically as a post-sponging or post-ragging step, using either a sponge pad or brush, as well as stamping, may be accomplished with much more accuracy and versatility because more than one color can be simultaneously used when the inventive palette 54 is employed. It is to be appreciated that faux tools other than rags, sponges and brushes shown herein may be effectively employed with the present multi-color palette to achieve the same benefits above described with respect to rags and brushes described herein.

Figure 18:
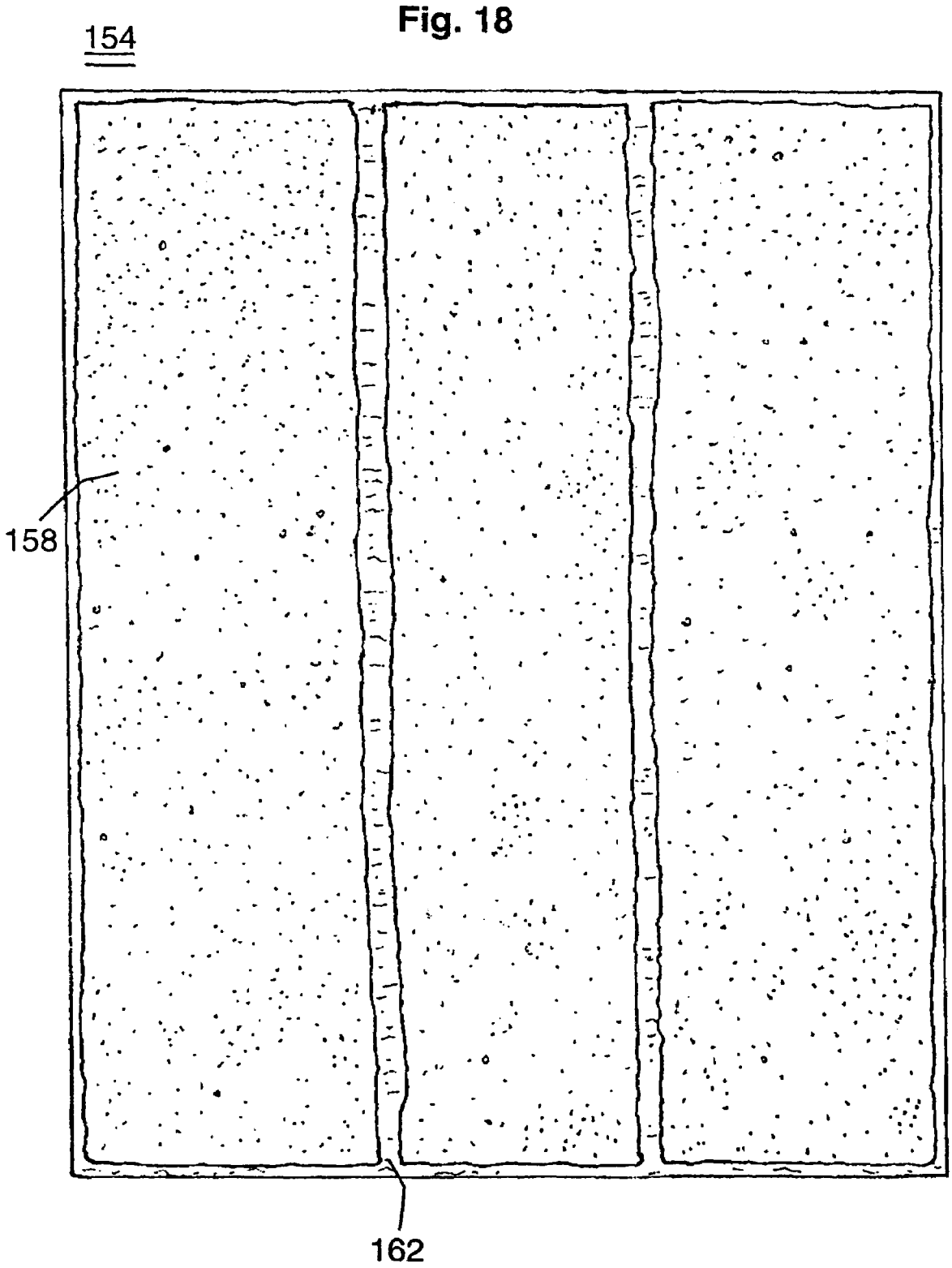
FIG. 18 illustrates a configuration of the inventive faux palette particularly adapted to produce an effect of wood or paneling, where the palette is used in the manner shown in FIG. 12 above.

With reference to FIG. 18, second embodiment 154 of the inventive palette is seen wherein random and substantially square and parallelogram-like sponges have been replaced by elongate substantially rectilinear planar sponges 158 which are separated by color dams 162. It has been found if said embodiment of the multi-color faux palette is applied directly against a wall in the manner above shown and described with respect to FIG. 12, the result is a wood or panel-like effect or design.

Figure 19:
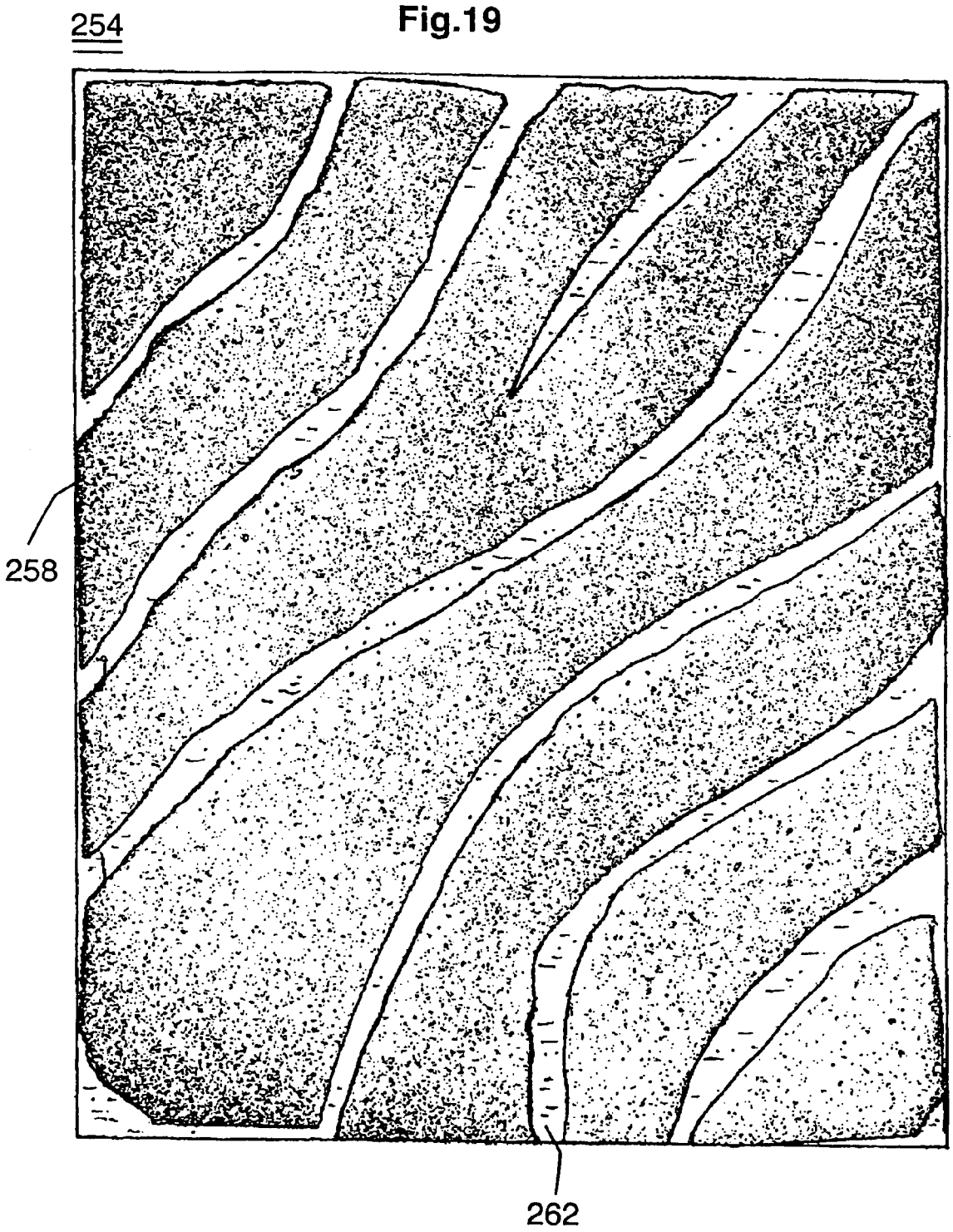
FIG. 19 is a faux palette, in accordance with the present invention, in which the planar sponges thereof are particularly adapted for the generation of marble designs, when the palette is used in the manner shown in FIG. 12 above.

Shown in FIG. 19 is a third embodiment 254 of the inventive multi-color faux palette in which there are provided curvilinear sponges 258 separated by color dams 262. It has been found that a marble-like faux pattern is readily obtainable when embodiment 254 is applied to wall 68 in the manner shown and described with respect to FIG. 12 above. Thereby, the inventive palette when used as a stamp or tool can produce unique and interesting effects. As such, the present system affords novel utility to the faux artist apart from its basic value in reducing the time and labor associated with present faux methods.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

Having thus described my invention, what I claim as new, useful, and non-obvious and, accordingly, secure by Letters Patent of the United States is:

1. A multi-color faux art color palette comprising:

(a) an integral substrate of a hard, but flexible, rubber having an upper and a bottom surface;

(b) a handle integrally dependent from said bottom surface of said substrate; and (c) a plurality of pigment-absorbent planar sponges of different shapes having a planar upper surface, arranged in a selectable pattern to define a faux art effect of interest, one or more of said planar sponges having at least one edge of an irregular shape, said sponges made of a material different from said integral substrate, capable of retaining a substantial quantity of a pigment color selected from a plurality of pigments, each of said planar sponges having a bottom surface dependent from said upper surface of said substrate, in which all opposing edges of said planar sponges are separated from each other by a distance sufficient to preclude contact therebetween when said planar sponges, during use of said palette, are compressed against a planar surface.

2. The palette as recited in claim 1 in which said pattern of said sponges includes at least one edge of each of said sponges substantially parallel to an opposing edge of another of said sponges.

3. The palette as recited in claim 1, in which said substrate comprises:

a polymeric material.

4. The palette as recited in claim 3, in which said planar sponges comprise;

a polymeric open cell material.

5. The palette as recited in claim 1, in which said planar sponges comprise:

natural sponges.

6. The palette as recited in claim 1, in which edges of each of said sponges are substantially transverse to said substrate.

* * * * *